US010004974B1

(12) United States Patent
Schneider

(10) Patent No.: US 10,004,974 B1
(45) Date of Patent: Jun. 26, 2018

(54) REMOVABLE INNER THIGH AND FRONTAL THIGH PROTECTOR FOR BASEBALL AND SOFTBALL CATCHERS AND UMPIRES

(71) Applicant: Dale Michael Schneider, Garden Grove, CA (US)

(72) Inventor: Dale Michael Schneider, Garden Grove, CA (US)

( * ) Notice: Subject to any disclaimer, the term of this patent is extended or adjusted under 35 U.S.C. 154(b) by 213 days.

(21) Appl. No.: 14/998,730

(22) Filed: Feb. 8, 2016

(51) Int. Cl.
*A63B 71/12* (2006.01)
*A41D 13/015* (2006.01)
*A41D 31/00* (2006.01)

(52) U.S. Cl.
CPC ..... *A63B 71/1225* (2013.01); *A41D 13/015* (2013.01); *A41D 31/0044* (2013.01); *A63B 2071/1241* (2013.01)

(58) Field of Classification Search
None
See application file for complete search history.

(56) References Cited

U.S. PATENT DOCUMENTS 2,266,886 A * 12/1941 McCoy ..... A41D 13/015 2/16
2,818,571 A 3/1955 Grant
4,455,686 A 6/1984 Zide
4,697,286 A * 10/1987 Cho ..... A63B 1/1225 2/22
6,079,050 A 6/2000 Hooper-Jackson
6,161,222 A 12/2000 Strickland
6,519,775 B1 2/2003 Garcia
9,265,291 B2 * 2/2016 Weber ..... A41D 13/0543

OTHER PUBLICATIONS

Sodl; Bassora; Huffman; Keenan; Case Report, Clinical Orthopaedics and Related Research, 466 (1), pp. 225-230.

* cited by examiner

*Primary Examiner* — Sarah B McPartlin

(57) ABSTRACT

An externally worn protective thigh pad which protects the inner and frontal thigh muscles from baseball or softball impacts. The protective thigh pad is designed specifically for the player who begins play by squatting behind a batter and spreading their legs. This is usually referred to as the catcher, but this could also be the umpire. The protective thigh pad provides a level of ballistic protection equal to the rest of the catchers gear. The protective thigh pad can be easily put on and removed for batting and base running. The protective thigh pad is comfortable enough to wear through nine innings of play. The protective thigh pad protects an area of the thigh from the inner thigh to the outer thigh and from the patella to the pubis. The protective thigh pad is circumferentially attached to the thigh then suspended from the waist keeping the pad in place.

5 Claims, 6 Drawing Sheets

REMOVABLE INNER THIGH AND FRONTAL THIGH PROTECTOR FOR BASEBALL AND SOFTBALL CATCHERS AND UMPIRES

CROSS-REFERENCE TO RELATED APPLICATIONS

This application claims the benefit of provisional patent application 62/282,143, filed 2015 Jul. 27 by the present inventor.

FEDERALLY SPONSORED RESEARCH

None.

SEQUENCE LISTING

None.

BACKGROUND

Prior Art

The following is a tabulation of some prior art that presently appears relevant:

| U.S. patents | | | |
|---|---|---|---|
| Pat. No. | Kind Code | Issue Date | Patentee |
| 2,818,571 | A | Mar. 24, 1955 | Grant |
| 4,455,686 | A | Jun. 26, 1984 | Zide |
| 6,161,222 | A | Dec. 19, 2000 | Strickland, Cheatwood |
| 6,519,775 | B1 | Feb. 18, 2003 | Garcia |
| 2,266,886 | A | Dec. 23, 1941 | McCoy |
| 6,079,050 | A | Jun. 27, 2000 | Hooper-Jackson |

Nonpatent Literature Documents

Sodl, Jeffrey F.; Bassora, Rocco; Huffman, G. Russell; Keenan, Mary Ann E., *Clinical Orthopaedics and Related Research* 466 (1): 225-30, "Case Report" (2008).

BACKGROUND

This patent application relates specifically to baseball or softball inner thigh and frontal thigh protector pads for the player who begins play by squatting behind a batter and spreading their legs. This is usually referred to as the catcher or umpire. In the beginning years of baseball catchers wore no protective gear and would stand well behind the batter. Over the years, rule changes made the catcher move closer to home plate. When catchers are so close to the batter reaction time is not fast enough to stop ball impacts from foul balls or bad pitches.

Squatting behind a batter with the legs spread leaves a catcher's thighs vulnerable to impacts from balls. High speed ball impacts to the front thigh or inner thigh can leave a catcher temporarily incapacitated, writhing on the ground in pain while the game continues on around them. When my youth-league son was playing catcher, a high-speed ball impacted his inner thigh and he had to be removed from the game.

Determined to prevent this from reoccurring I searched for a piece of equipment or device if you will, that could be worn on the outside of the uniform, provide a level of ballistic protection equal to the rest of the catchers gear, be easily put on and removed for batting and base running, be comfortable enough to wear through nine innings of play and protect an area of the thigh from the inner thigh to the outer thigh and from the patella to the pubis.

Thigh protection that is out on the market for sale is extensive, with thigh pads for Football, La Crosse, Cricket, Martial Arts, Rugby, and other contact sports. Yet a review of all the thigh pads available reveal several deficiencies compared to the requirements listed above.

Pads for football are designed for the front of the thigh U.S. Pat. No. 2,818,571 (1955) Grant. These types of pads are for preventing "quadriceps contusion" and its most serious manifestation, myositis ossificans, boney tumors which can cause debilitating pain Sodl, et al, (2008). Some of the pads even protect the side of the thigh U.S. Pat. No. 4,455,686 (1984) Zide. None of these pads provide protection to the inner thigh and they do not completely cover the frontal thigh. Since these pads are worn inside the pants in internal pockets, the pads are not removable and must be worn the whole game. These kinds of pads will affect the running ability of the person wearing them. When a catcher bats and runs the bases they need the freedom to move like other players who aren't wearing protective gear.

The pads for Cricket, Rugby, La Crosse, and the other such sports suffered from the same deficiencies. They are designed to protect various parts of the outer and frontal thigh. None of these pads would have protected my son because he was struck on the inner thigh close to the pubis, specifically on portions of the semitendinosus muscle, the gracilis muscle, and part of the adductor longus muscle.

The construction or style of these types of pads reflects the specific needs of each sport. Players in these sports need to be quite mobile for their playing positions. They need to be able to run forward, backward, as well as laterally, and do it fast! Someone who is running is someone who is standing. A baseball or softball catcher is a playing position unlike these sports. They begin their play by assuming a squatting position with their legs spread open. The catcher does not have to be as mobile as other sports since the majority of their play involves the immediate area around home plate.

Protective thigh pads that are removable can have a more robust impact resistance than an internally worn pad. There is a garment design for a pad to protect the inner thigh specifically U.S. Pat. No. 6,161,222 (2000) Strickland, Cheatwood. This pad would not be suitable for the protection catchers like my son require. Not only do these pads not offer frontal thigh protection leaving significant areas unprotected, but the ballistic protection afforded the inner thigh is not robust enough for high speed impacts. The level of protection required is the same ballistic protection a catcher's mask, chest protector, or shin guard would provide. It is a level of protection where a player can take a direct hit from a fast pitch and be unharmed. Unharmed, their confidence to withstand more ball impacts grows until fear of pain is banished from their mind. An additional problem is the garment pads are not removable from the garment, so the catcher would have to bat and run while wearing these pads slowing them down.

Other types of thigh protection can be seen in the construction industry U.S. Pat. No. 6,519,775 (2003) Garcia. Most of these are designed to protect the front of the thigh from abrasions. Other pads for protecting the frontal thigh were examined and still they would not offer the needed protection for someone squatting with their legs spread U.S. Pat. No. 2,266,886 (1941) McCoy. Additionally these pads hang loose and are not firmly attached circumferentially around the thigh. Wearing a pad that does not stay in place could injure the player or leave gaps for ball strikes.

During my search for inner and frontal thigh protection a protective garment was found which protected the inner thigh U.S. Pat. No. 6,079,050 (2000) Hooper-Jackson. Still the kind of protection offered was protection from friction between the thighs, the most serious injury being a friction rash. This type of inner thigh padding would provide limited if any protection from a ball impact.

Assuming your playing position by squatting isn't the only way a catcher's thigh gets impacted by balls. Poorly thrown pitches by the pitcher that strike the ground in front of home plate are called dirt balls. When pitches are thrown in the dirt, we train our youth-league catchers to drop to their knees and block the ball with their body, or as we like to say "assume the blocking position". Dropping to your knees exposes the frontal thigh and the inner thigh to direct ball impacts. At the youth-league level an astounding number of pitches are in the dirt and I have sent catcher after catcher to go get beaten up behind home plate. After too much of this the kids shy away from playing catcher and then you have to order someone to play the position. Clearly what is needed is thigh protection where the kid's thighs are protected from injury.

Pulling a catcher out of a game because of ball impacts may not seem like such a big deal. Still, starting at the high school level, then college level, and lastly the major leagues, the catcher is the player who calls the plays for the game. The day or night before the game, they study the statistics for the opposing team's batters and plan a strategy for each one. During the game, this strategy is communicated to the pitcher through a series of hand signs. Since the catcher has the best view of the field, they also call the plays for infielders and outfielders, usually communicating this through arm or hand signals. Pitchers come and go during the game but a catcher is rarely replaced. They normally play a full game and taking out a catcher can have a huge effect.

None of the protective pads reviewed so far would provide impact protection to the full inner and frontal thigh in the blocking position against dirt balls. At best they would only provide partial protection.

Concluding my search I found that there was no device which could be worn on the outside like the rest of the traditional gear, provide a level of ballistic protection equal to the rest of the catchers gear, be easily put on and removed for batting and base running, be comfortable enough to wear through nine innings of play and lastly protect an area of the thigh from the inner thigh to the outer thigh and from the patella to the pubis.

SUMMARY

Thigh pads that provide protection for the full inner thigh and full frontal thigh from ball impacts, specifically for a player or umpire who begins play by squatting behind a batter and spreading their legs. The pad has minimal effect on the catcher's ability to run. The pad can be removed from the catcher in less than five seconds and can be put back on in less than thirty seconds. Once installed, the pad provides thigh protection to an area bounded by the visible semitendinosus muscle as the boundary for the inner thigh, across the front of the thigh to the side boundary marked by the iliotibial muscles. The bottom boundary of the protected area starts just above the patella, then to the top boundary marked by where the pubis starts. A catcher or umpire wearing traditional protective gear coupled with wearing the protective thigh pad would have full facing body protection from ball strikes.

DRAWINGS

DETAILED DESCRIPTION

Figure 1:
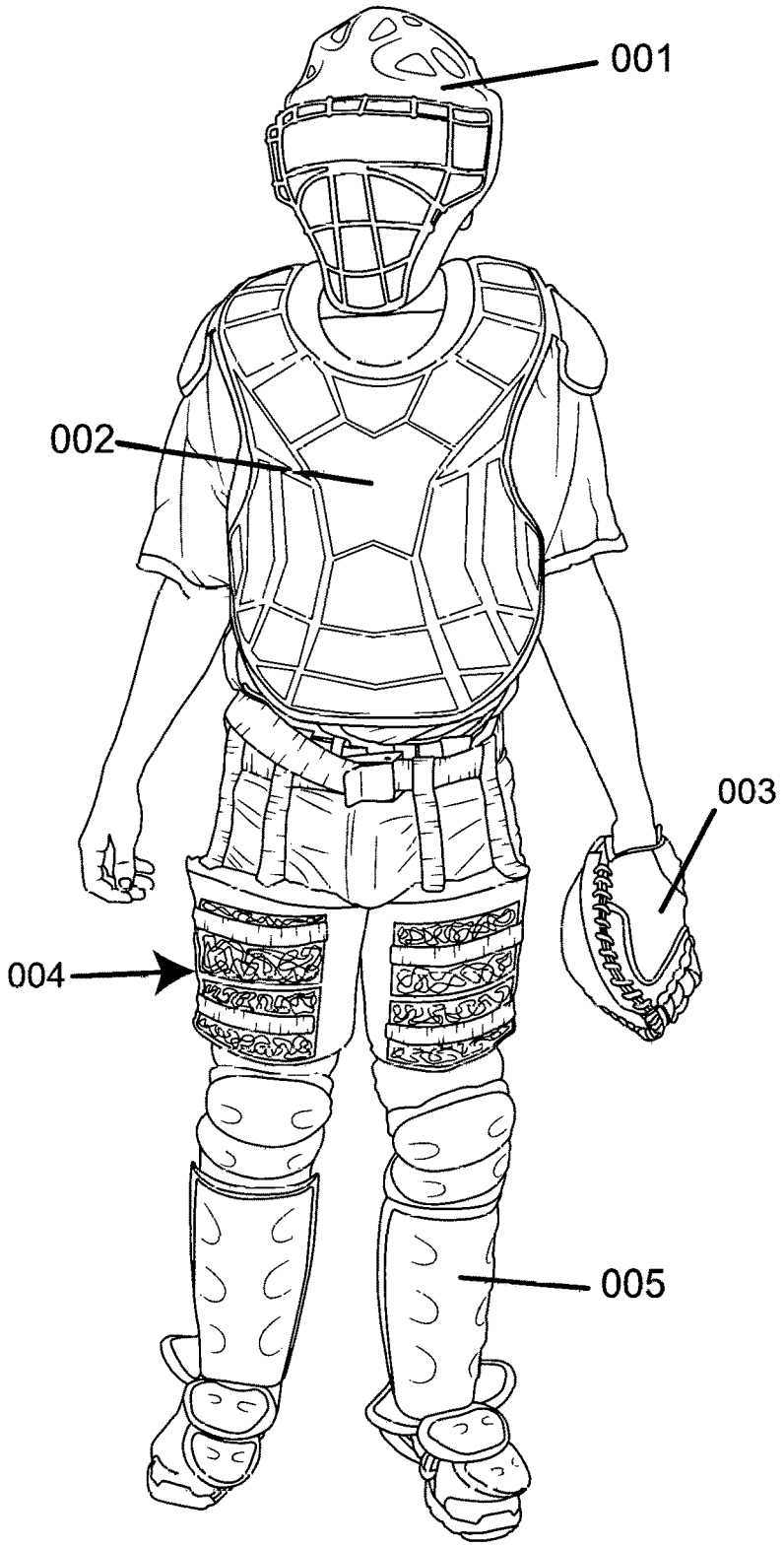
FIG. 1 is a perspective view of a baseball or softball player wearing traditional protective gear, including the protective thigh pad.
Figure 2:
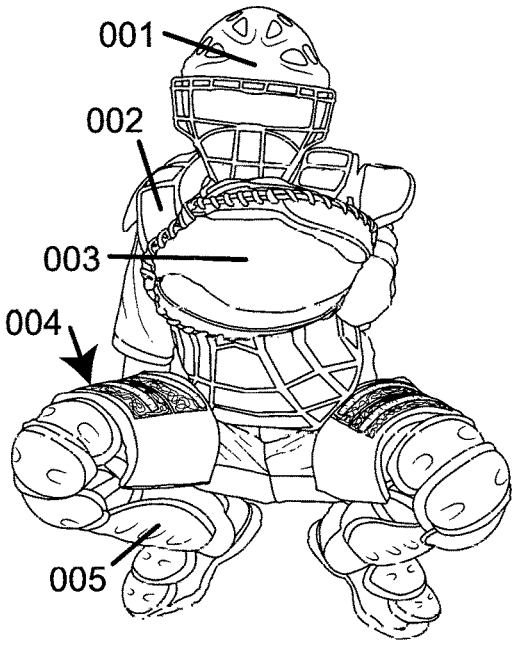
FIG. 2 is a perspective view of a baseball or softball player in the squatting position, wearing traditional protective gear, including the protective thigh pad.

Expressed in FIG. 1 and FIG. 2 is the first embodiment of the protective thigh pad. Said protective thigh pad is suspended from the waist hanging downward covering the front of the thigh and inner thigh. Attachment at the waist provides horizontal torsion stability while at the same time becoming the anchor for the vertical anchor attachment. For vertical stability the protective pad is circumferentially attached to the thigh. In FIG. 2 the catcher is shown in the squalling position wearing the thigh pad illustrating the level of coverage of the pad. I presently contemplate this embodiment could be made from durable fabric as the pad holder, closed cell foam for impact resistance and nylon strapping with Velcro for attachment. However this embodiment could be made from different materials, such as plastics, leather, rubber, metals, ceramics, various foams, clothe padding, rivets, hooks, claps or any combination of materials or attachment hardware.

The second embodiment of said protective thigh pad is that it is removable. For catchers the pad is worn on the outside and is taken off or put on quickly, averaging less than a minute. Since umpires don't have to run the bases, the protective pad could be worn under the umpire's uniform and removed at the end of the game.

Figure 3:
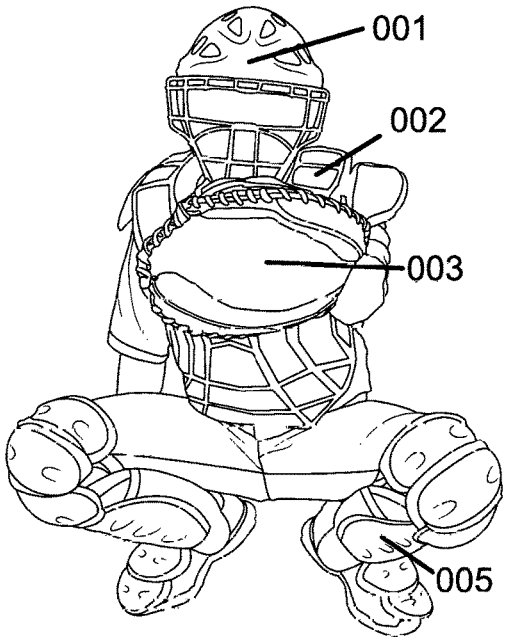
FIG. 3 is a perspective view of a baseball or softball player in the squatting position, wearing traditional protective gear, without the protective thigh pad.

FIG. 1 is a perspective view taken from the user's frontal side standing wearing full traditional catcher's protective gear 001, 002, 003, 005, including said protective thigh pad 004. FIG. 2 is a perspective view taken from the user's frontal side in the squatting position with their legs spread wearing full traditional catcher's protective gear 001, 002, 003, 005, and showing said protective thigh pad 004. FIG. 3 is a perspective view taken from the user's frontal side in the squatting position with their legs spread wearing full traditional catcher's protective gear 001, 002, 003, 005, and not wearing said protective thigh pad.

Figure 4:
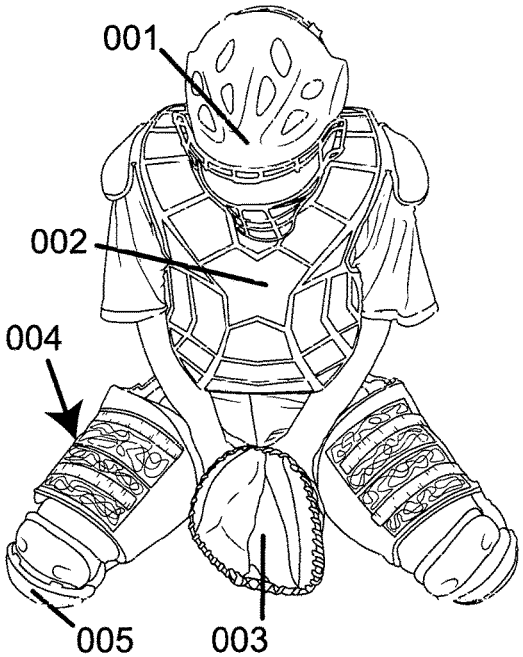
FIG. 4 is a perspective view of a baseball or softball player in the blocking position, wearing traditional protective gear, including the protective thigh pad.
Figure 5:
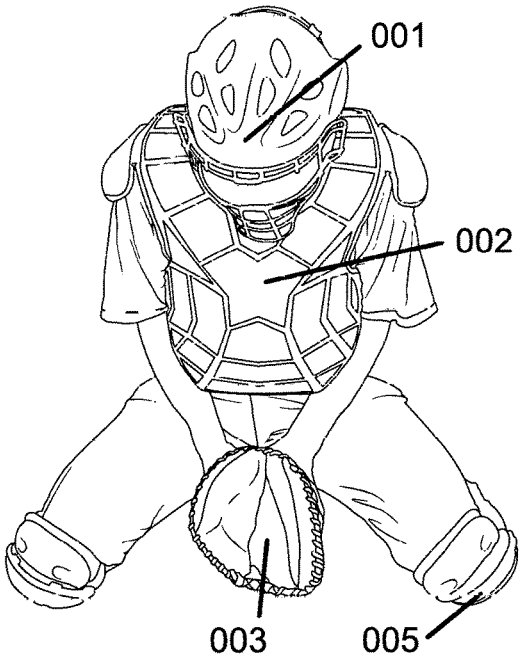
FIG. 5 is a perspective view of a baseball or softball player in the blocking position, wearing traditional protective gear, without the protective thigh pad.

FIG. 4 is a perspective view taken from the user's frontal side on their knees in the blocking position, wearing full traditional catcher's protective gear 001, 002, 003, 005, and showing said protective thigh pad 004. When the pitcher throws a wild pitch into the dirt, catchers throw their bodies in front of the ball. Wearing said protective thigh pads gives full head-on protection from ball strikes. FIG. 5 is a perspective view taken from the user's frontal side on their knees in the blocking position, wearing full traditional catcher's protective gear 001, 002, 003, 005, and not wearing said protective thigh pad. Here a catcher is shown with the unprotected areas of the inner and frontal thigh.

Figure 6:
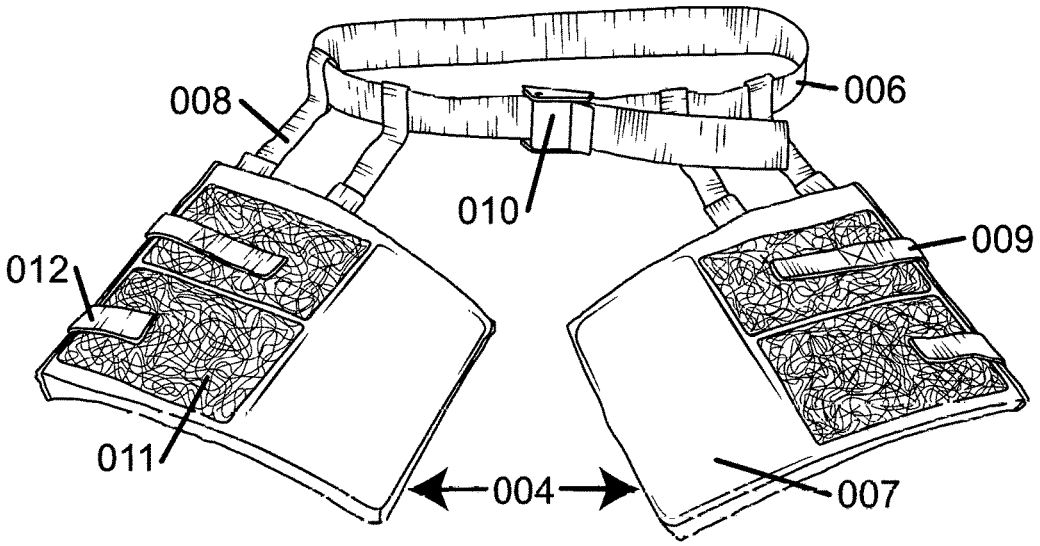
FIG. 6 is a perspective front view of a set of left and right protective pads suspended from a belt.
Figure 7:
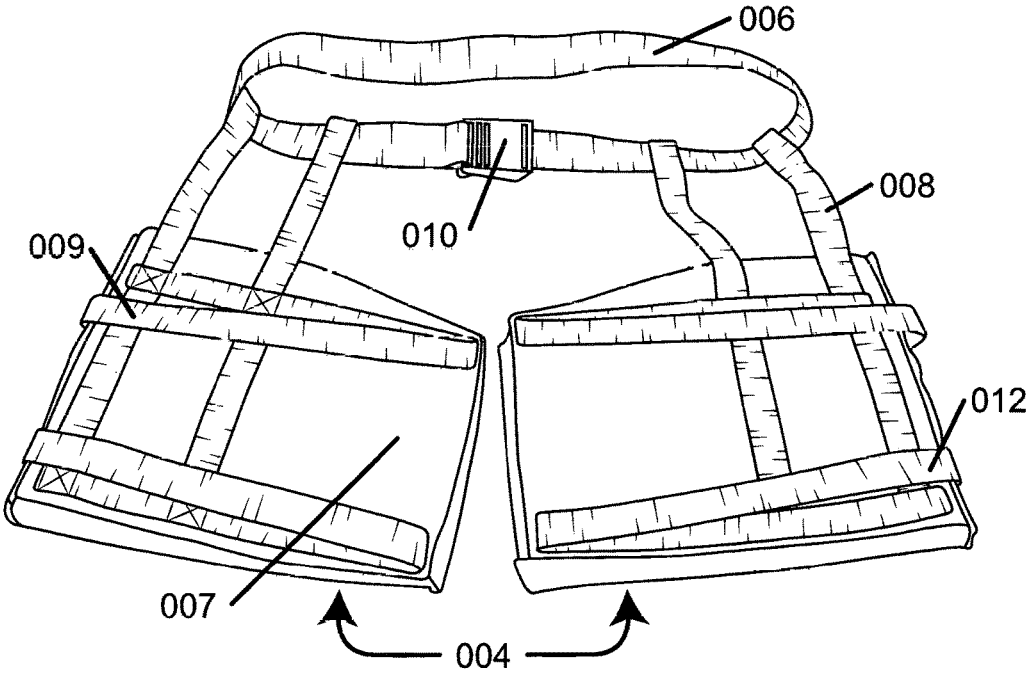
FIG. 7 is a perspective back view of a set of left and right protective pads suspended from a belt.

FIG. 6 is a front perspective view of the protective thigh pad 004 and its major components, a belt 006 with clasp 010, a pad pocket 007, and nylon strapping 008, to hang the protective thigh pad 004, from the belt 006. Across the front of the pad pocket are Velcro loop patches 011, to serve as anchor points for the strapping 009, 012, which attaches the protective thigh pad 004 circumferentially around the thigh. FIG. 7 is a back perspective view of the protective thigh pad 004 and its major components, a belt 006 with clasp 010, a pad pocket 007, anchored on the back nylon strapping 008, to hang the protective thigh pad 004 from the belt 006. Anchored to the back is strapping 012 and 009 used to attach the protective pad circumferentially around the thigh.

Figure 8:
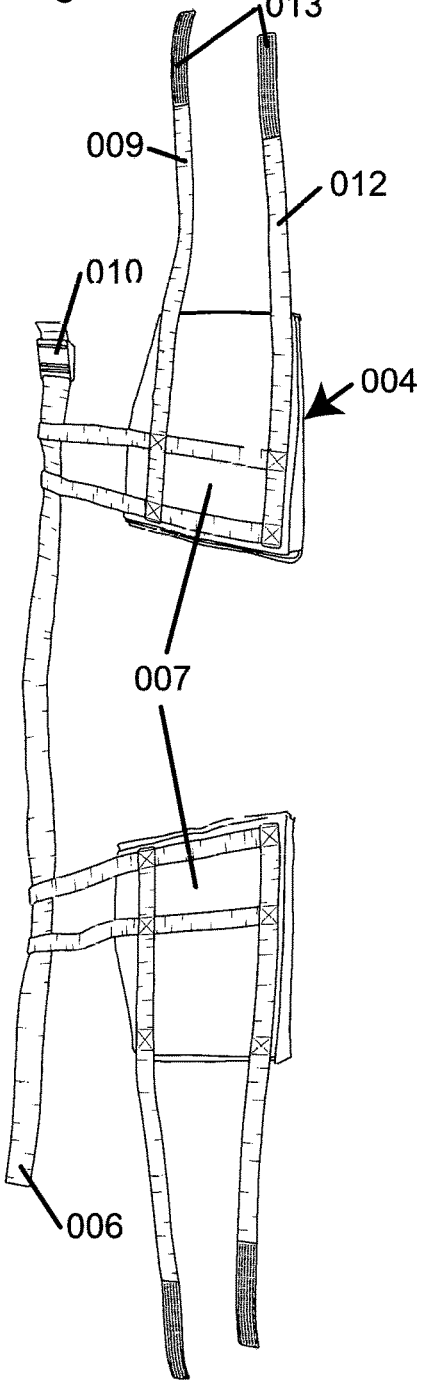
FIG. 8 is a perspective back view of a set of left and right protective pads suspended from a belt, and with the thigh straps open in the ready to install position.
Figure 9:
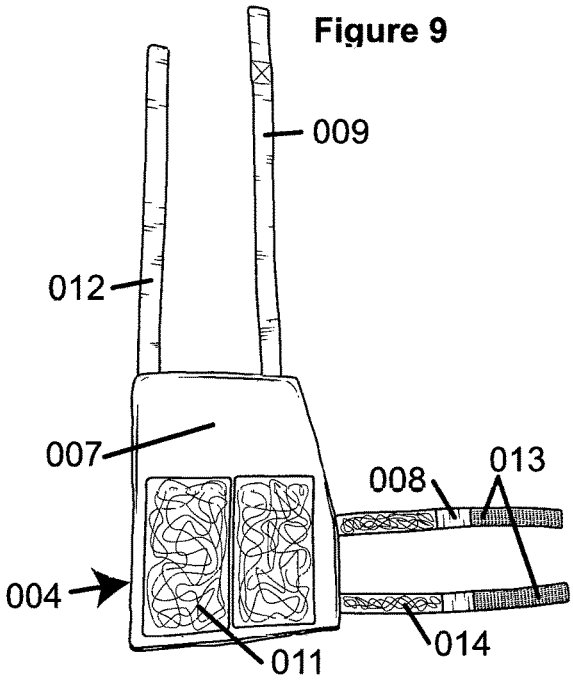
FIG. 9 is a perspective front view of a single protective pad with thigh and belt anchoring straps open.
Figure 10:
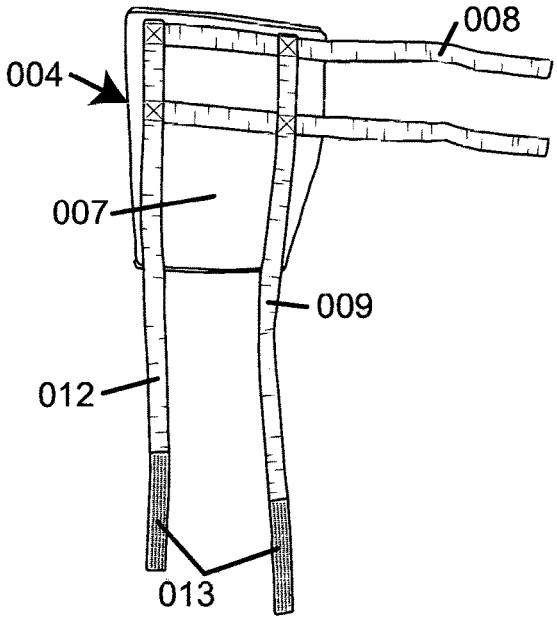
FIG. 10 is a perspective back view of a single protective pad with thigh and belt anchoring straps open.

FIG. 8 is a back view of left and right protective thigh pads 004, with the belt 006, clasp 010, in the open ready to install position. The belt 006 is open with the protective thigh pads 004, hanging from the belt. The circumferentially attachment straps 009 and 012, are open and not attached. FIG. 9 is a front view of a single protective pad 004 and strapping 008, 009, 012. Mounted on strapping 008 is Velcro hook 013 and Velcro loop 014 used to hang the pad pocket 007 from the belt into position on the thigh. Attached across the front of the pad are 2 Velcro loop patches 011, which serve as anchor points for the straps, 009, and 012, attaching the protective pad circumferentially around the thigh. At the ends of strapping 009 and 012 is Velcro hook 013 which serves to anchor the strapping to the Velcro Loop patch 011 on the front of the protective pad. FIG. 10 is a back view of a single protective pad 004, a pad pocket 007, strapping 008, 009, 012, and Velcro hook 013.

Figure 11A:
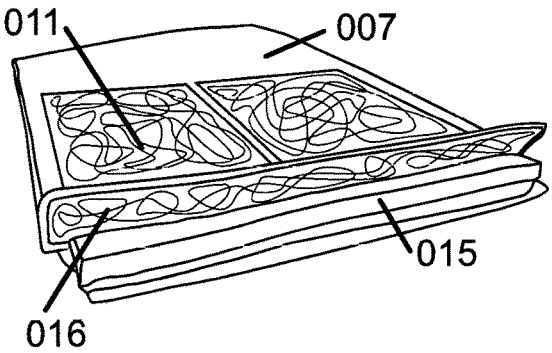
FIGS. 11A and 11B are perspective orthogonal views of a single pad pocket which holds impact resistant padding.
Figure 11B:
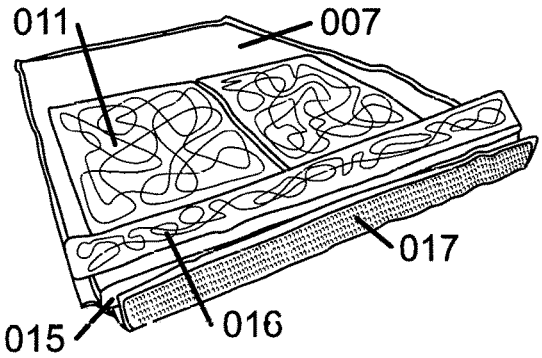
Figure 12:
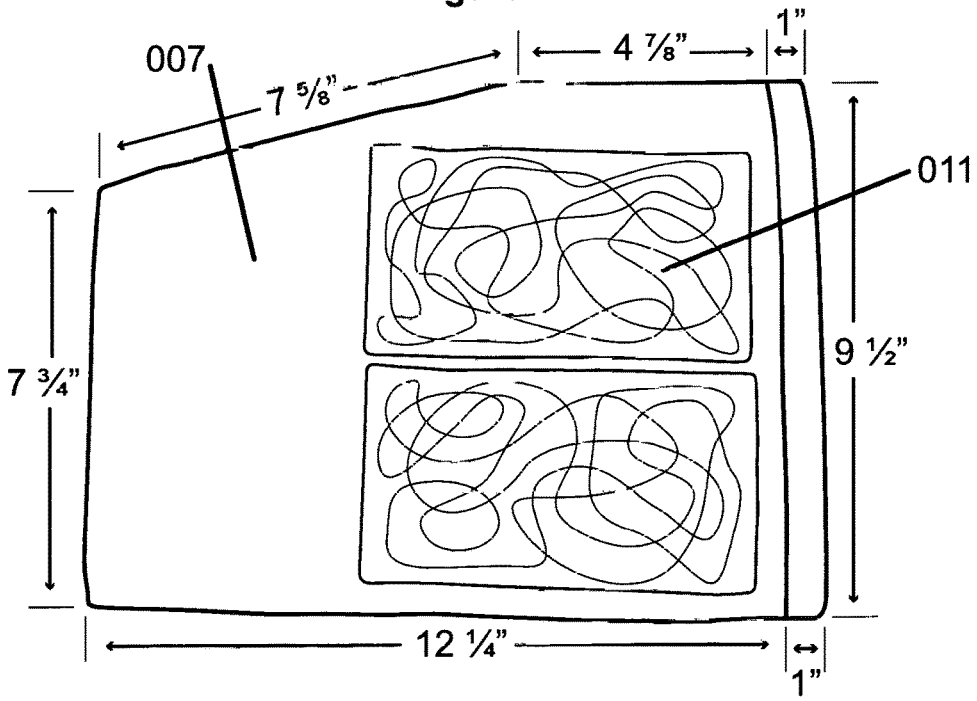
FIG. 12 is a perspective front view a single pad pocket with measurements.
Figure 13:
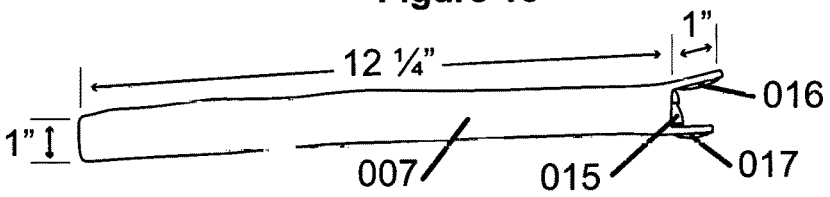
FIG. 13 is a perspective side view of a single pad pocket.

FIG. 11A and FIG. 11B are perspective views of the pad pocket 007 with foam pad 015, partial inserted. The pad pocket enclosure has a 1 inch overhang for FIG. 11A Velcro loop 016 and FIG. 11B Velcro hook 017, to securely close the foam pad 015, inside the pad pocket 007. Across the front of the pocket are two Velcro loop pieces 011 to serve as anchor points for strapping that attaches the protective pad circumferentially to the thigh. FIG. 12 shows the measurements of the pad pocket 007 with 1 inch overhang for pocket closure. FIG. 13 is a perspective view of the side of a single pad pocket 007 with Velcro loop tab 016, Velcro hook tab 017. The finished pad pocket 007 is a uniform 1 inch thick. The finished size of the pad pocket must be big enough to cover the muscles in FIG. 14, FIG. 15, FIG. 16.

Figure 14:
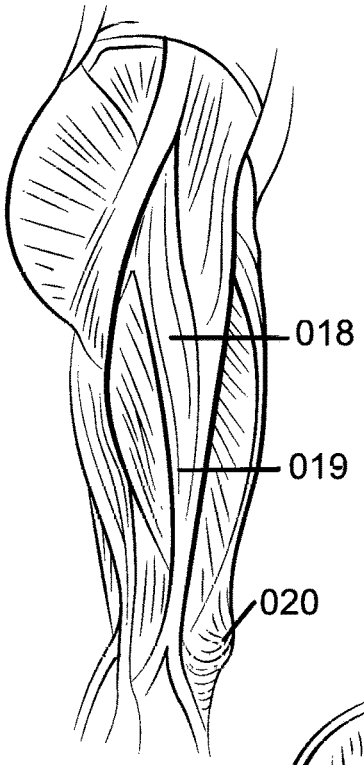
FIG. 14 is a perspective view of a human anatomy showing the outer boundary of muscles protected by the protective pad.
Figure 16:
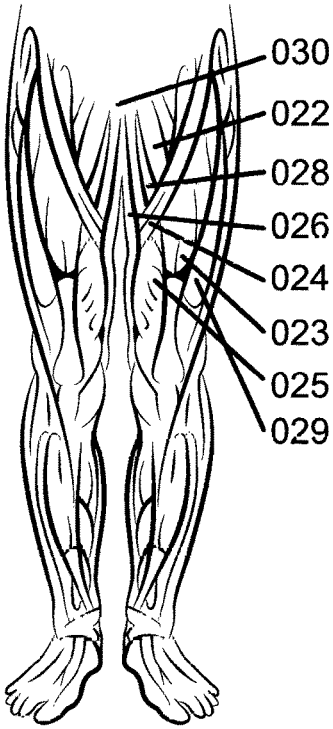
FIG. 16 is a perspective view of a human anatomy showing the frontal boundary of muscles protected by the protective pad.
Figure 15:
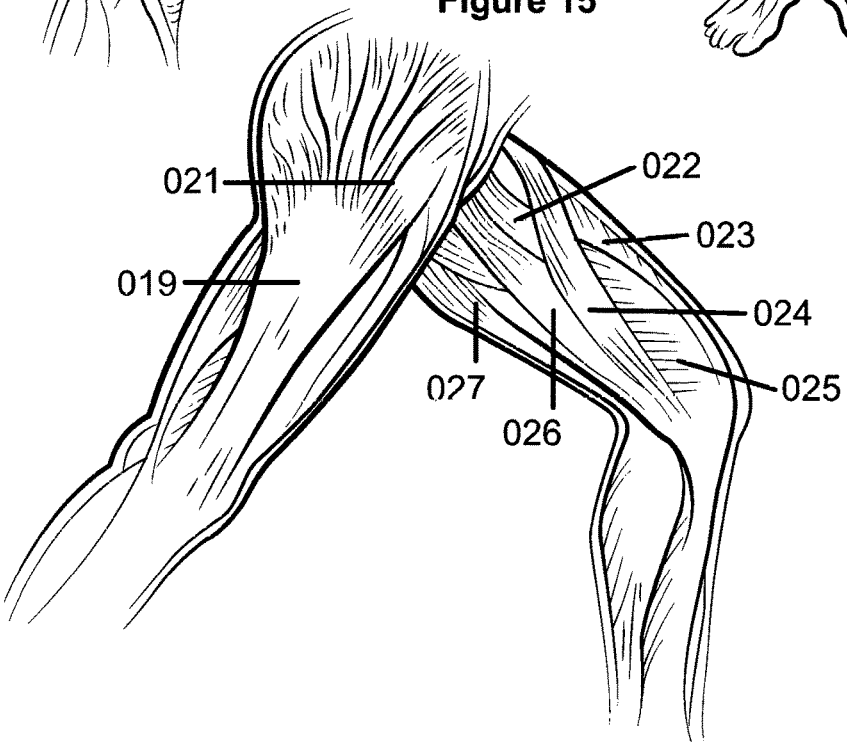
FIG. 15 is a perspective view of a human anatomy showing the inner boundary of muscles protected by the protective pad.

FIG. 14 is a side view of the human musculature 018, 019, indicating the outside boundary of protection afforded by the protective thigh pad 004. FIG. 14 020 indicates the lower boundary of the protection afforded by the protective thigh pad 004. FIG. 15 is a side view of human musculature of the inner thigh 022, 023, 024, 025, 026, 027, indicating the inner thigh area protected by the protective thigh pad 004. FIG. 15 027 indicates the inner boundary of the protection afforded by the protective thigh pad 004. FIG. 16 is a frontal view of the human musculature 022, 028, 026, 024, 023, 025, 029, 030 indicating the frontal and partial inner thigh area protected by the protective thigh pad 004.

REFERENCE NUMERALS

001 Catcher's mask
002 Catcher's chest protector
003 Catcher's glove
004 Inner thigh and frontal thigh protector
005 Shin guard
006 Belt
007 Pad pocket
008 Nylon strapping to hang pad pocket from belt, cut to 23 inches
009 Nylon strapping to attach pad pocket to thigh circumferentially, cut to 30½ inches long
010 Belt clasp
011 Velcro loop 4 inches by 6 inches
012 Nylon strapping to attach pad pocket to thigh circumferentially, cut to 27 inches
013 Velcro hook cut to 6 inches
014 Velcro loop cut to 6 inches
015 Foam pad cut to fit pocket size FIG. 12
016 Velcro loop for pad pocket enclosure
017 Velcro hook for pad pocket enclosure
018 Iliotibial hand
019 Iliotibial tract
020 Patella
021 Tensor Fascia latae
022 Adductor longus
023 Rectus femoris
024 Sartorius
025 Vastus medialis
026 Gracilis
027 Semitendinosus
028 Adductor magnus
029 Vastus lateralis
030 Pubis Operation In operation one attaches the protective pad to the thigh by first attaching the nylon straps FIG. 6 008, to the belt 006. The straps 008 are centered over the front of the thigh, and once in place the belt is adjusted and tightened. The thigh straps FIGS. 8 009 and 012, are wrapped around the circumference of the thigh and attached by a Velcro hook in FIG. 8 013, to the Velcro loop on the front of the pad seen in FIG. 9 011 securing the pad to the circumference of the thigh.

Once the pad is centered over the front of the thigh and secured around the circumference of the thigh the pad provides:

(1) In the squatting position, the pads provide inner thigh protection from ball impacts, against the full length of the visible portion of the semitendinosus muscle as seen in FIG. 15 27, to the full length of the gracilis muscle in FIG. 15 26, the full length of the adductor longus muscle in FIG. 15 022, the full length of the rectus femoris in FIG. 15 023, the full length of the sartorius muscle in FIG. 15 024, the full length of the vastus medialis muscle in FIG. 15 025.

(2) In the squatting position, the pads provide full frontal thigh protection from ball impacts to the full length of the adductor longus muscle in FIG. 15 022, the full length of the rectus femoris muscle in FIG. 16 023, the full length of the vastus medialis muscle in FIG. 16 025, the full length of the adductor magnus muscle in FIG. 16 028, and the full length of the vastus lateralist muscle in FIG. 16 029.

(3) In the blocking position, the pads provide full inner thigh and full frontal thigh protection from ball impacts to the full length of the adductor longus muscle in FIG. 15 022, the full length of the rectus femoris muscle in FIG. 15 023, the full length of the sartorius muscle in FIG. 15 024, the full length of the vastus medialis muscle in FIG. 15 025, the full length of the gracilis muscle in FIG. 15 026, the full length of the visible portion of the semitendinosus muscle in FIG. 15 027, the full length of the adductor magnus in FIG. 16 028 and the full length of the vastus medialis in FIG. 16 029.

When the user wants to remove the pads, the side straps are pulled away from the front of the pad, releasing the Velcro and freeing the circumferentially attached pad from the thigh. The quick release belt is opened dropping the protective pads to the ground.

CONCLUSIONS, RAMIFICATIONS, AND SCOPE

After reading the description, the reader will see that at least one embodiment of the protective thigh pad provides protection to the catcher's exposed thigh like no other pad. The protective thigh pad provides protection from the inner thigh to the outer thigh and the patella to the pubis. A catcher or umpire wearing traditional protective gear face mask, shin guards, chest protector and wearing the protective thigh pad, would have full frontal protection from ball strikes. All foul balls or errant pitches that impact a catcher would strike a body part that is covered by some form of impact protection. It's the kind of protection that turns confidence into bravery and one that is needed for baseballs and softballs toughest position.

Worn on the outside as a piece of removable gear allows for a robust design which can mirror the ballistic protection of the catchers traditional gear, face mask, shin guards, chest protector. Worn externally allows the pad to be removed for batting and base running.

Circumferentially attaching the protective pad to the thigh secures the pad around the muscles to be protected. The protective pad is suspended from the waist which provides the anchor point for torsion stability keeping the pad from moving laterally. Suspension from the waist also aids in keeping the pad centered over the inner and frontal thigh.

While my above description contains many specifics, these should not be construed as limitations on the scope but rather as an exemplification of one or more embodiments thereof. Many variations are possible. For example, I presently contemplate the protective thigh pad could be made from durable fabric as the pad holder, closed cell foam for impact resistance and nylon strapping with Velcro for attachment. However, the pad holder, padding, and attachment hardware, could be made from different materials, such as plastics, leather, rubber, metals, ceramics, various foams, cloth padding, rivets, hooks, claps or any combination of materials or attachment hardware. Additionally, in the description the protective thigh pad is suspended from its own belt assembly. In operation the thigh pad could be suspended from the player's uniform belt just as easily.

Accordingly, the scope should be determined not by the embodiment illustrated but by the appended claims and their legal equivalents.

I claim:

1. A protective thigh pad assembly configured to hang from the waist of a baseball or softball catcher, the assembly comprising:

two planar pads, wherein each planar pad comprises a bottom edge, exterior and interior edges perpendicular to said bottom edge, and a top edge, wherein a first portion of said top edge, extending from said exterior edge to a point between said exterior edge and a midpoint of said top edge, is parallel to said bottom edge and a second portion of said top edge, extending from said point to said interior edge tapers downward from the first portion at an angle of approximately 15 degrees, each planar pad filled with cushioning material; and an attachment structure, said attachment structure comprising two first straps extending perpendicularly from the first portion of said top edge and defining an articulation region for the assembly with respect to the waist of the baseball or softball catcher and two second attachment straps extending perpendicularly to said interior edge, wherein the two first straps are adapted to suspend the assembly from the waist of the baseball or softball catcher and the two second straps are adapted to circumferentially extend around a thigh of the baseball or softball catcher.

2. The protective thigh pad assembly of claim 1, wherein said exterior edge is configured to conform and be positioned adjacent an outside of the baseball or softball catcher's thigh and said interior edge is configured to conform and be positioned adjacent the baseball or softball catcher's groin area.

3. The protective thigh pad assembly of claim 1, wherein said two planar pads are each constructed of a durable fabric pocket with an open end for receiving cushion material, hook or loop fastener is positioned an outer surface of each pad and serves as an anchor point for said two second straps.

4. The protective thigh pad assembly of claim 1, wherein the cushion material is a single layer or multi-layer closed cell foam sheets.

5. The protective thigh pad assembly of claim 1, wherein the two first straps are nylon straps each attached to both said bottom edge and said first portion of said top edge, said first two straps extend perpendicularly from and beyond said first portion of said top edge and have hook and loop fasteners such that a length of each of the first two straps can be independently adjusted with respect to the waist of the baseball catcher or softball catcher and the two second straps are attached to a rear surface of each pad and extend from said exterior edge to said interior edge and beyond said interior edge, said two second straps have hook or loop fasteners adapted to engage with an outer surface of each pad.

* * * * *